US010612534B2

(12) United States Patent
Kanai et al.

(10) Patent No.: US 10,612,534 B2
(45) Date of Patent: Apr. 7, 2020

(54) VARIABLE DISPLACEMENT SWASH PLATE TYPE COMPRESSOR

(71) Applicant: KABUSHIKI KAISHA TOYOTA JIDOSHOKKI, Aichi (JP)

(72) Inventors: Akinobu Kanai, Kariya (JP); Kenji Yamamoto, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 98 days.

(21) Appl. No.: 16/072,404

(22) PCT Filed: Feb. 10, 2017

(86) PCT No.: PCT/JP2017/004868
§ 371 (c)(1),
(2) Date: Jul. 24, 2018

(87) PCT Pub. No.: WO2017/145798
PCT Pub. Date: Aug. 31, 2017

(65) Prior Publication Data

US 2018/0363637 A1 Dec. 20, 2018

(30) Foreign Application Priority Data

Feb. 22, 2016 (JP) ..... 2016-031529

(51) Int. Cl.
*F04B 27/18* (2006.01)
*F25B 49/02* (2006.01)
(Continued)

(52) U.S. Cl.
CPC ..... *F04B 27/1804* (2013.01); *F04B 39/1046* (2013.01); *F25B 49/022* (2013.01);
(Continued)

(58) Field of Classification Search
CPC .. F04B 27/0804; F04B 27/1804; F04B 39/10; F04B 39/1046; F25B 49/022; F25B 2700/1933
See application file for complete search history.

(56) References Cited

U.S. PATENT DOCUMENTS

| | | | |
|---|---|---|---|
| 7,651,321 | B2 | 1/2010 | Ota et al. |
| 2006/0165535 | A1 | 7/2006 | Ota et al. |
| 2019/0032648 | A1* | 1/2019 | Satake ..... F04B 27/1804 |

FOREIGN PATENT DOCUMENTS

| | | |
|---|---|---|
| JP | 2006-207464 | 8/2006 |
| JP | 2006-207465 | 8/2006 |

(Continued)

OTHER PUBLICATIONS

Official Communication issued in International Patent Application No. PCT/JP2017/004868, dated Apr. 11, 2017.

*Primary Examiner* — Marc E Norman
(74) *Attorney, Agent, or Firm* — Greenblum & Bernstein, P.L.C.

(57) ABSTRACT

When a suction pressure is lower than a set suction pressure, and a crank chamber pressure is higher than a control pressure in a second supply passage, a first valve body reduces an opening degree of a suction passage, and a second valve body opens a bleed passage. When the suction pressure is higher than the set suction pressure, and the crank chamber pressure is higher than the control pressure, the first valve body increases the opening degree of the suction passage, and the second valve body opens the bleed passage. When the crank chamber pressure is lower than the control pressure, the first valve body reduces the opening degree of the suction passage, and the second valve body closes the bleed passage.

8 Claims, 7 Drawing Sheets

(51) Int. Cl.
*F04B 39/10* (2006.01)
*F04B 27/08* (2006.01)

(52) U.S. Cl.
CPC ..... *F04B 27/0804* (2013.01); *F04B 39/10* (2013.01); *F25B 2700/1933* (2013.01)

(56) References Cited

FOREIGN PATENT DOCUMENTS

| | | |
|---|---|---|
| JP | 5050801 | 9/2008 |
| JP | 4412184 | 11/2009 |
| WO | 2017/145798 | 8/2017 |

* cited by examiner

VARIABLE DISPLACEMENT SWASH PLATE TYPE COMPRESSOR

TECHNICAL FIELD

The present invention relates to a variable displacement swash plate type compressor.

BACKGROUND ART

Conventionally, a variable displacement swash plate type compressor (hereinafter, simply referred to as "compressor") described in Japanese Patent Laid-Open No. 2006-207464 is known. The compressor includes a housing, a swash plate, a plurality of pistons, a suction passage, and a displacement control valve. The housing has a suction chamber, a plurality of cylinder bores, a crank chamber and a discharge chamber. The swash plate is provided in the crank chamber, and an inclination angle of the swash plate is changed depending on a crank chamber pressure in the crank chamber. The piston is accommodated in the cylinder bore, and forms a compression chamber between the piston and the housing. Further, the piston reciprocates in the cylinder bore with a stroke corresponding to the inclination angle. In this manner, the piston sucks refrigerant in the suction chamber into the compression chamber, compresses the refrigerant in the compression chamber, and discharges high-pressure refrigerant to the discharge chamber from the compression chamber. The suction passage connects the outside to the suction chamber. The displacement control valve is capable of changing the crank chamber pressure.

To be more specific, the compressor has: a first supply passage which makes the discharge chamber and the displacement control valve communicate with each other; a second supply passage which connects the displacement control valve to the crank chamber; and a bleed passage which connects the crank chamber to the suction chamber. The displacement control valve regulates a communicating area between the first supply passage and the second supply passage. The compressor further includes an opening degree regulating valve. The opening degree regulating valve is provided in a valve accommodation chamber which is formed in the housing, communicates with the outside, and extends in the radial direction. The opening degree regulating valve has a valve chamber which has an inlet port opening to the outside, and extends in the radial direction. A suction communication hole which communicates with the suction chamber, and has a communication port opening to the valve chamber; a bleed communication hole which communicates with the crank chamber, and has a bleed port opening to the valve chamber; and a control communication hole which communicates with the second supply passage, and has a control port opening to the valve chamber are formed in the housing. A first valve body and a second valve body which are movable in the radial direction, and a bias spring which connects the first valve body to the second valve body are accommodated in the valve chamber. The first valve body and the second valve body move in the radial direction due to a differential pressure between a suction pressure of the refrigerant before the refrigerant is sucked into the suction chamber and a crank chamber pressure.

In this compressor, when the differential pressure between the suction pressure and the crank chamber pressure increases, the first valve body reduces an opening degree of the suction passage, and the second valve body reduces an opening degree of the bleed passage. On the other hand, when the differential pressure between the suction pressure and the crank chamber pressure decreases, the first valve body increases the opening degree of the suction passage, and the second valve body increases the opening degree of the bleed passage. Thus, in this compressor, while pressure loss of the suction pressure at a high displacement is prevented, pressure variation in the suction pressure at a low displacement is minimized, so that quiet is ensured.

However, in the above-mentioned conventional compressor, volumetric efficiency at the low displacement is insufficient, and at the time of startup, it is difficult to rapidly drain liquid refrigerant or the like which may be filled in the crank chamber, so that the displacement is difficult to be rapidly increased.

That is, in this compressor, the second valve body of the opening degree regulating valve cannot close the bleed passage, and at the low displacement, the compression phase is performed again by draining the high-pressure refrigerant in the crank chamber to the suction chamber and hence, volumetric efficiency is insufficient. Accordingly, when an opening area of the bleed passage is set small, the liquid refrigerant or the like which may be filled in the crank chamber cannot be rapidly drained to the suction chamber at the time of startup, so that it is difficult to rapidly increase the displacement.

Accordingly, in order to ensure sufficient volumetric efficiency at the low capacity, and also to allow the liquid refrigerant or the like to be rapidly drained to the suction chamber at the time of startup, it may be considered a technique where, while the opening area of the bleed passage is set large, a separate bleed valve is used which can change the opening area of the bleed passage, as described in Japanese Patent Laid-Open No. 2011-185138, for example. In this case, it is considered that, by allowing the bleed valve to release the opening area of the bleed passage at the time of startup, the liquid refrigerant or the like can be rapidly drained to the suction chamber at the time of startup, so that the displacement can be rapidly and easily increased. It is also considered that, by allowing the bleed valve to close the opening area of the bleed passage at the low displacement, the high-pressure refrigerant in the crank chamber is not compressed again and hence, volumetric efficiency is increased.

However, with the use of such a separate bleed valve, the parts count is increased thus causing an increase in manufacturing cost and reduction of design flexibility.

The present invention has been made in the light of the conventional circumstances described above, and an object of the invention is to provide a variable displacement swash plate type compressor capable of solving all of the following tasks.

(1) While pressure loss of a suction pressure at a high displacement can be prevented, quiet at a low displacement can be also ensured.

(2) High volumetric efficiency at the low displacement can be realized without causing an increase in manufacturing cost and reduction of design flexibility.

(3) Liquid refrigerant or the like which may be filled in a crank chamber can be rapidly drained at the time of startup, so that the displacement can be rapidly increased.

A compressor according to the present invention includes:

a housing having a suction chamber, a cylinder bore, a crank chamber, and a discharge chamber;

a swash plate provided in the crank chamber, an inclination angle of the swash plate being changed depending on a crank chamber pressure in the crank chamber;

a piston accommodated in the cylinder bore and forming a compression chamber between the piston and the housing, the piston that sucks refrigerant in the suction chamber into the compression chamber, compresses the refrigerant in the compression chamber, and discharges the high-pressure refrigerant to the discharge chamber from the compression chamber by reciprocating in the cylinder bore with a stroke corresponding to the inclination angle; and a displacement control valve provided in the housing, and being capable of changing the crank chamber pressure, wherein a suction passage that connects the outside to the suction chamber, a first supply passage that makes the discharge chamber and the displacement control valve communicate with each other, a second supply passage that connects the displacement control valve to the crank chamber, and a bleed passage that connects the crank chamber to the suction chamber are formed in the housing, a valve chamber that has an inlet port opening to the outside and extends in a first direction, a suction communication hole that communicates with the suction chamber and has a communication port opening to the valve chamber, a bleed communication hole that communicates with the crank chamber and has a bleed port opening to the valve chamber, and a control communication hole that communicates with the second supply passage and has a control port opening to the valve chamber are formed in the housing, a first valve body that is movable in the first direction and changes an opening area of the communication port, a second valve body that is movable in the first direction and changes an opening area of the bleed port, and a bias spring that connects the first valve body to the second valve body are accommodated in the valve chamber, when a suction pressure of the refrigerant being taken into the suction chamber is lower than a set suction pressure, and the crank chamber pressure is higher than a control pressure in the second supply passage, the first valve body is configured to reduce an opening degree of the suction passage, and the second valve body is configured to open the bleed passage, when the suction pressure is higher than the set suction pressure, and the crank chamber pressure is higher than the control pressure, the first valve body is configured to increase the opening degree of the suction passage, and the second valve body is configured to open the bleed passage, and when the crank chamber pressure is lower than the control pressure, the first valve body is configured to reduce the opening degree of the suction passage, and the second valve body is configured to close the bleed passage.

Other aspects and advantages of the invention will be apparent from embodiments disclosed in the attached drawings, illustrations exemplified therein, and the concept of the invention.

DESCRIPTION OF EMBODIMENTS

Hereinafter, embodiments 1 to 4 that embody the present invention will be described with reference to the drawings.

Embodiment 1

Figure 1:
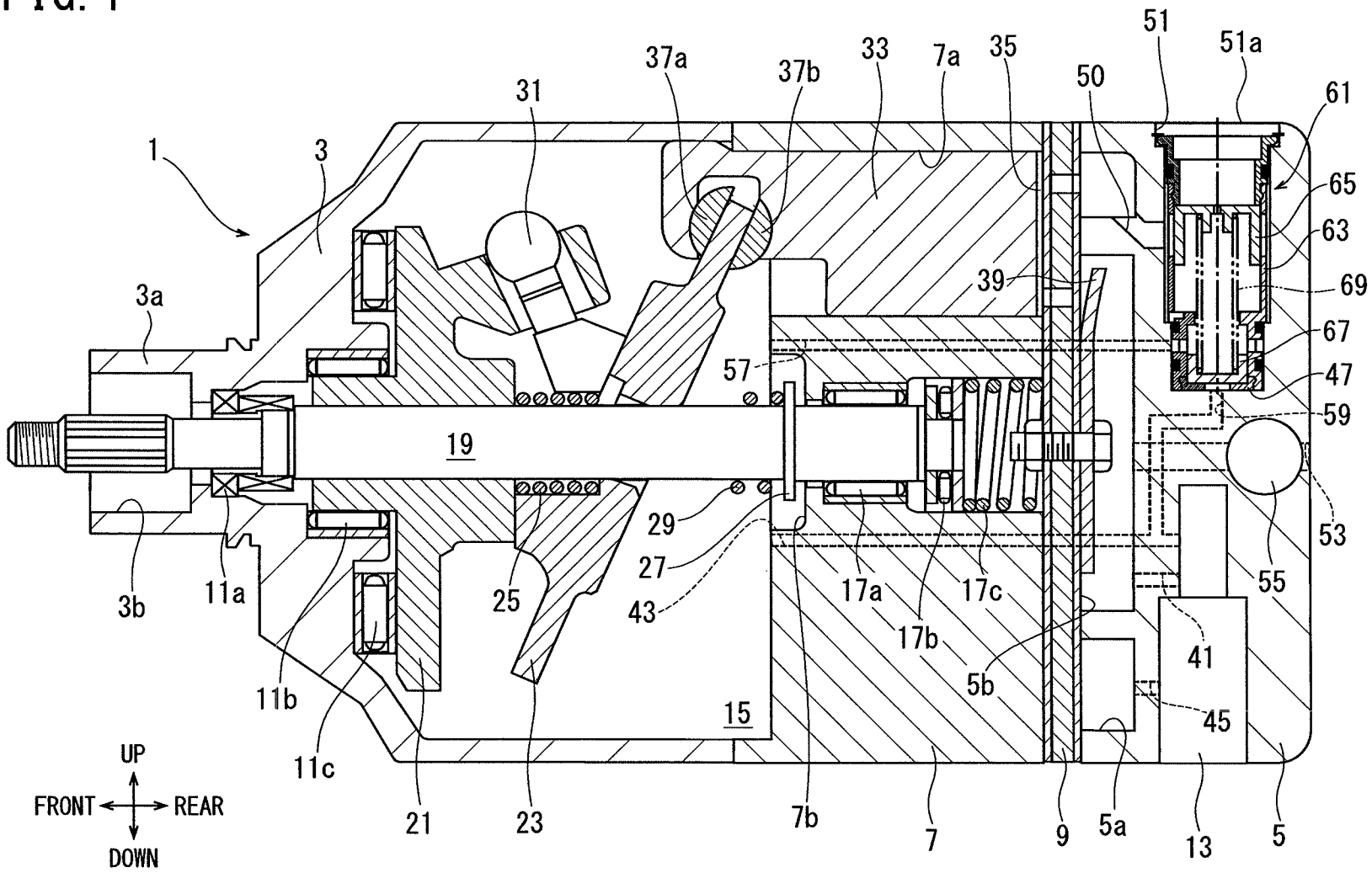
FIG. 1 is a sectional view of a compressor according to embodiment 1.

As shown in FIG. 1, a compressor according to embodiment 1 is a variable displacement swash plate type compressor of a single-head piston type. This compressor is mounted on vehicles, and constitute refrigeration circuits of air-conditioning apparatus.

A housing 1 of the compressor includes a front housing 3, a rear housing 5, a cylinder block 7, and a valve forming plate 9. In this embodiment, the longitudinal direction of the compressor is defined assuming that the side on which the front housing 3 is located is a front side of the compressor, and the side on which the rear housing 5 is located is a rear side of the compressor. Moreover, in FIG. 2 and subsequent figures, the longitudinal direction is defined according to the longitudinal direction in FIG. 1. The posture of the compressor changes as appropriate according to a vehicle or the like on which the compressor is mounted.

A boss 3*a* which projects frontward is formed on the front housing 3. A first axial hole 3*b* extending in the longitudinal direction of the compressor is formed in the boss 3*a*. A shaft seal device 11*a* and a first radial bearing 11*b* are installed in the first axial hole 3*b*. Further, a first thrust bearing 11*c* is installed on the rear surface of the front housing 3.

A suction chamber 5*a* and a discharge chamber 5*b* are formed in the rear housing 5. Further, a displacement control valve 13 is provided in the rear housing 5. The suction chamber 5*a* is located at the radially outer position of the rear housing 5. The suction chamber 5*a* is connected to an external evaporator through an inlet port 51*a* of a suction passage 51, which will be described later. The discharge chamber 5*b* is located at the radially inner position of the rear housing 5. The discharge chamber 5*b* is connected to an external condenser via a discharge passage 53. A check valve 55 is provided in the discharge passage 53. The air-conditioning apparatus is formed by the compressor, the condenser, an expansion valve, the evaporator and the like.

The cylinder block 7 is located between the front housing 3 and the valve forming plate 9. A crank chamber 15 is formed between the front housing 3 and the cylinder block 7. A plurality of cylinder bores 7*a* is formed in the cylinder block 7 at equiangular intervals in the circumferential direction. A front portion of the cylinder bore 7*a* communicates with the crank chamber 15.

Further, a second axial hole 7*b* which is coaxial with the first axial hole 3*b* is formed in the cylinder block 7. A second radial bearing 17*a*, a second thrust bearing 17*b* and a press spring 17*c* are provided in the second axial hole 7*b*.

A drive shaft 19 is inserted through the front housing 3 and the cylinder block 7. The drive shaft 19 is inserted through the shaft seal device 11*a* in the front housing 3. The drive shaft 19 is also inserted through the second radial bearing 17*a* and the second thrust bearing 17*b* in the cylinder block 7. Thereby, the drive shaft 19 is supported by the housing 1, and is rotatable around a rotational axis which is parallel to the longitudinal direction of the compressor.

A lug plate 21 is press-fitted to the drive shaft 19. The lug plate 21 is disposed at the front side in the crank chamber 15, and is rotatable in the crank chamber 15 as the drive shaft 19 rotates. The first radial bearing 11*b* and the first thrust bearing 11*c* are installed between the lug plate 21 and the front housing 3.

Further, the drive shaft 19 is also inserted through a swash plate 23. The swash plate 23 is located at the rear of the lug plate 21 in the crank chamber 15. An inclination reduce spring 25 is provided around the drive shaft 19 between the lug plate 21 and the swash plate 23. Moreover, a circlip 27 is fixed on a rear portion of the drive shaft 19, and a return spring 29 is provided around the drive shaft 19 between the circlip 27 and the swash plate 23.

The lug plate 21 and the swash plate 23 are connected by a link mechanism 31 in the crank chamber 15. The link mechanism 31 supports the swash plate 23 such that an inclination angle of the swash plate 23 with respect to the lug plate 21 can be changed.

A piston 33 is reciprocally accommodated in the cylinder bore 7*a*. The rear end surface of the piston 33 faces the valve forming plate 9 in the cylinder bore 7*a*. Thereby, the piston 33 defines a compression chamber 35 at a rear portion of cylinder bore 7*a*.

Shoes 37*a* and 37*b* paired in the longitudinal direction are provided between the piston 33 and the swash plate 23. The pair of shoes 37*a* and 37*b* converts the rotation of the swash plate 23 into reciprocating movement of the piston 33. The piston 33 can reciprocate in the cylinder bore 7*a* by the pair of shoes 37*a* and 37*b* at a stroke corresponding to the inclination angle of the swash plate 23.

The valve forming plate 9 is formed such that a suction valve plate, a valve plate and a discharge valve plate are laminated in this order from the front side. A suction reed valve, a suction port, a discharge port, and a discharge reed valve are formed on the valve forming plate 9 corresponding to the cylinder bore 7*a*. In the discharge chamber 5*b* of the rear housing 5, a retainer 39 is fixed to the rear surface of the valve forming plate 9. The retainer 39 restricts a maximum opening degree of the discharge reed valve.

Figure 2:
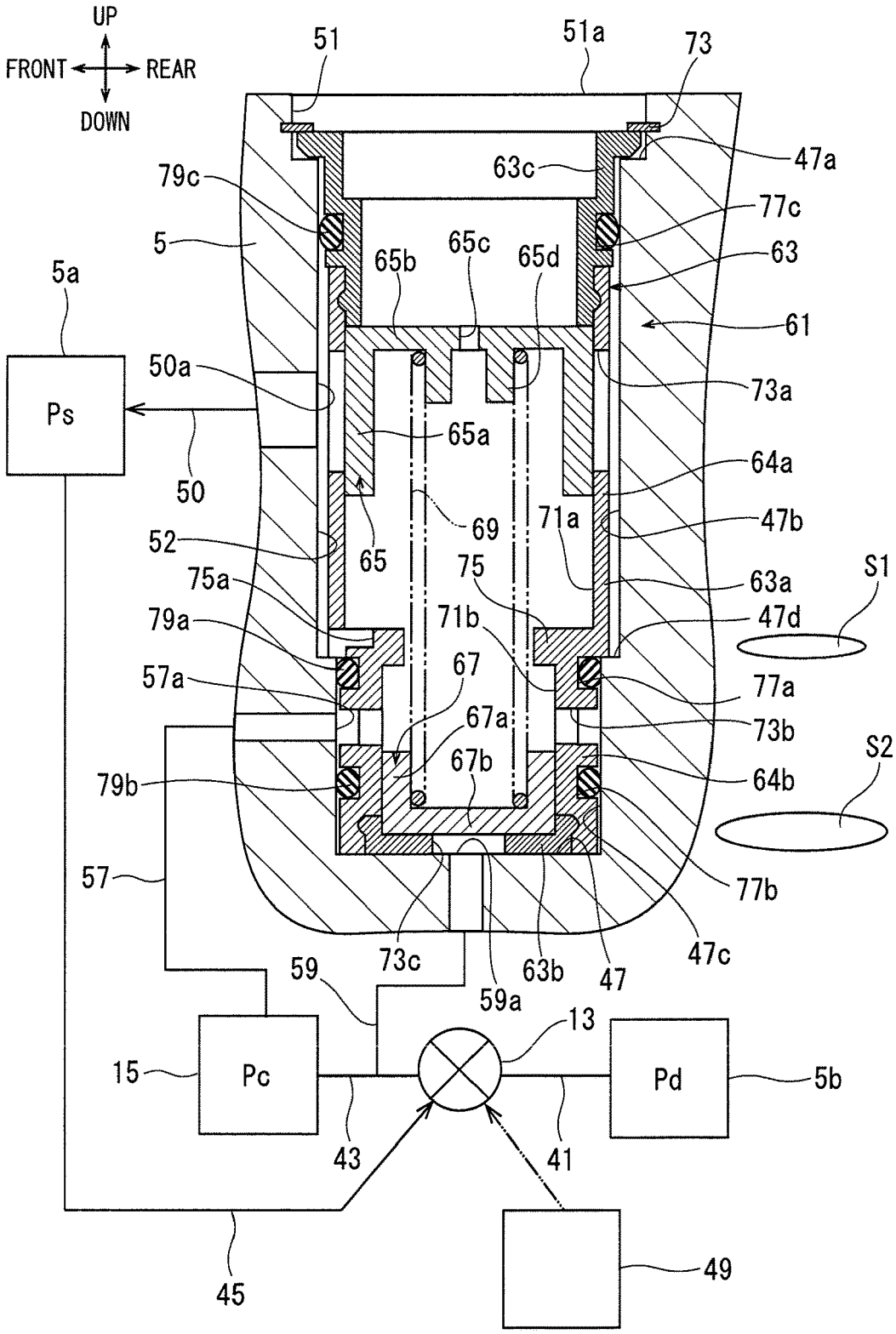
FIG. 2 is an enlarged sectional view of an essential part of the compressor according to embodiment 1 at the time of startup.

As shown in FIG. 2, the compressor has: a first supply passage 41 which makes the discharge chamber 5*b* and the displacement control valve 13 communicate with each other; a second supply passage 43 which connects the displacement control valve 13 to the crank chamber 15; and a detection passage 45 which makes the suction chamber 5*a* and the displacement control valve 13 communicate with each other. Further, the compressor also has a valve accommodation chamber 47 which communicates with the inlet port 51*a*, and extends in the radial direction. The first supply passage 41, the detection passage 45 and the valve accommodation chamber 47 are formed in the rear housing 5, and the second supply passage 43 is formed through the rear housing 5, the retainer 39, the valve forming plate 9 and the cylinder block 7. The displacement control valve 13 regulates a communicating area between the first supply passage 41 and the second supply passage 43 in accordance with a suction pressure Ps in the suction chamber 5*a* and a control signal from a controller 49.

The rear housing 5 is an example of a "housing body". The valve accommodation chamber 47 has: the inlet port 51*a* having a columnar shape and communicating with the outside; a first valve accommodation chamber 47*b* which has a columnar shape, is continuous with the inlet port 51*a*, and has a smaller diameter than that of the inlet port 51*a*; and a second valve accommodation chamber 47*c* which has a columnar shape, is continuous with the first valve accommodation chamber 47*b*, and has a smaller diameter than that of the first valve accommodation chamber 47*b*. Step portions 47*a* and 47*d* are respectively formed between the inlet port 51*a* and the first valve accommodation chamber 47*b* and between the first valve accommodation chamber 47*b* and the second valve accommodation chamber 47*c*. An opening degree regulating valve 61 is provided in the valve accommodation chamber 47.

The opening degree regulating valve 61 includes a valve case 63, a first valve body 65, a second valve body 67, and a bias spring 69. The valve case 63 is formed by a cylindrical body 63*a*, a lid body 63*b*, and a support body 63*c*. The cylindrical body 63*a* is formed by: a large-diameter portion 64*a* having a cylindrical shape with a diameter slightly smaller than that of the first valve accommodation chamber 47*b*; and a small-diameter portion 64*b* coaxially integrated with the large-diameter portion 64*a*, and having a cylindrical shape with a diameter slightly smaller than that of the second valve accommodation chamber 47*c*. The inside of the large-diameter portion 64*a* corresponds to a first valve chamber 71*a*, and the inside of the small-diameter portion 64*b* corresponds to a second valve chamber 71*b*. A number of suction apertures 73*a* which make the first valve accommodation chamber 47*b* and the first valve chamber 71*a* communicate with each other are formed in the large-diameter portion 64*a* in the circumferential direction. Further, a number of bleed apertures 73*b* which make the second valve accommodation chamber 47*c* and the second valve chamber 71*b* communicate with each other are formed in the small-diameter portion 64*b* in the circumferential direction.

The opening degree regulating valve 61 is inserted into the valve accommodation chamber 47, and is prevented from slipping off by the circlip 73. In such a state, a lower portion of the large-diameter portion 64*a* of the opening degree regulating valve 61 comes into contact with the step portion 47*d* formed by the first valve accommodation chamber 47*b* and the second valve accommodation chamber 47*c*.

A flange 75 which projects inwardly and annularly is formed between the large-diameter portion 64*a* and the small-diameter portion 64*b*. The flange 75 restricts a lower position of the first valve body 65 and, at the same time, restricts an upper position of the second valve body 67. When the second valve body 67 is seated on the flange 75, a first pressure receiving area S1 is provided on the upper surface of the second valve body 67 by an inner diameter of the flange 75, and a second pressure receiving area S2 larger than the first pressure receiving area S1 is provided on the lower surface of the second valve body 67.

A number of valve communication holes 75*a* which make the first valve accommodation chamber 47*b* and the first valve chamber 71*a* communicate with each other are formed in the flange 75 in the circumferential direction. The valve communication holes 75*a* are configured not to be closed even when the first valve body 65 is located at the lower position. Further, O-ring grooves 77*a* and 77*b* which sandwich the bleed apertures 73*b* in the vertical direction are formed on the small-diameter portion 64*b*, and O-rings 79*a* and 79*b* are provided in the O-ring grooves 77*a* and 77*b* respectively. The O-rings 79*a* and 79*b* are in contact with the inner peripheral surface of the second valve accommodation chamber 47*c*.

The lid body 63*b* is fixed to an end portion of the small-diameter portion 64*b* on the side being opposite to the large-diameter portion 64*a*. A through hole 73*c* is formed in the lid body 63*b*. The support body 63*c* is fixed to an upper portion of the large-diameter portion 64*a*. The support body 63*c* also has a cylindrical shape. The lid body 63*b* restricts a lower position of the second valve body 67, and the support body 63*c* restricts an upper position of the first valve body 65. An O-ring groove 77*c* is formed on the support body 63*c*, and an O-ring 79*c* is provided in the O-ring groove 77*c*. The O-ring 79*c* is in contact with the inner peripheral surface of the first valve accommodation chamber 47*b*.

The first valve body 65 is formed by a cylindrical portion 65*a* having a cylindrical shape, and a lid portion 65*b* integrated with an upper portion of the cylindrical portion 65*a* and having a disk shape. A vent hole 65*c* and a spring seat 65*d* are provided on the lid portion 65*b*. The first valve body 65 is slidable in the first valve chamber 71*a*.

The second valve body 67 is formed by a cylindrical portion 67*a* having a cylindrical shape, and a lid portion 67*b* integrated with a lower portion of the cylindrical portion 67*a* and having a disk shape. The second valve body 67 is slidable in the second valve chamber 71*b*. The bias spring 69 is held between the spring seat 65*d* of the first valve body 65 and the lid portion 67*b* of the second valve body 67, and spaces the first valve body 65 away from the second valve body 67 by the biasing force of the bias spring 69.

A suction communication hole 50, a bleed communication hole 57 and a control communication hole 59 are formed in the rear housing 5. The suction communication hole 50 communicates with the suction chamber 5*a*, and a communication port 50*a* opens to the first valve accommodation chamber 47*b*. The inlet port 51*a* of the valve accommodation chamber 47, the inner peripheral surface of the support body 63*c*, the first valve chamber 71*a*, the suction apertures 73*a*, the first valve accommodation chamber 47*b* and the suction communication hole 50 form the suction passage 51. Accordingly, the suction pressure Ps of the refrigerant before sucked into the compressor acts on the upper surface of the first valve body 65. The communication port 50*a* opens to the first valve accommodation chamber 47*b* in the axial direction parallel to the drive shaft 19. The first valve body 65 changes an opening area of the communication port 50*a* by changing an opening area of the suction apertures 73*a*.

The bleed communication hole 57 communicates with the crank chamber 15, and a bleed port 57*a* opens to the second valve accommodation chamber 47*c*. The bleed port 57*a* communicates with the second valve chamber 71*b* through the second valve accommodation chamber 47*c* and the bleed apertures 73*b*. The bleed port 57*a* also opens to the second valve accommodation chamber 47*c* in the axial direction. The bleed communication hole 57, the bleed apertures 73*b*, the second valve chamber 71*b*, the first valve chamber 71*a*, the valve communication holes 75*a*, the first valve accommodation chamber 47*b* and the suction communication hole 50 form a bleed passage 52. The second valve body 67 changes an opening area of the bleed port 57*a* by changing an opening area of the bleed apertures 73*b*.

The control communication hole 59 communicates with the second supply passage 43, and a control port 59*a* opens to the second valve accommodation chamber 47*c*. The control port 59*a* communicates with the second valve chamber 71*b* through the second valve accommodation chamber 47*c* and the through hole 73*c*. The control port 59*a* opens in the radial direction at an end portion of the second valve accommodation chamber 47*c* on a side being opposite to the inlet port 51*a*. Accordingly, a control pressure Pcv in the second supply passage 43 acts on the lower surface of the second valve body 67.

In this compressor, the drive shaft 19 is driven to rotate by an engine or a motor of a vehicle, then the lug plate 21 and the swash plate 23 rotate, and thus the piston 33 reciprocates in the cylinder bore 7*a*. At this time, the piston 33 reciprocates in the cylinder bore 7*a* at the stroke corresponding to the inclination angle of the swash plate 23. Accordingly, the piston 33 sucks the refrigerant in the suction chamber 5*a* into the compression chamber 35, compresses the refrigerant in the compression chamber 35, and discharges the high-pressure refrigerant to the discharge chamber 5*b* from the compression chamber 35.

During this time, in this compressor, a crank chamber pressure Pc in the crank chamber 15 is regulated by the displacement control valve 13, whereby the discharge displacement can be suitably changed. For example, when the displacement control valve 13 increases the communicating area between the first supply passage 41 and the second supply passage 43, the refrigerant at a discharge pressure Pd in the discharge chamber 5*b* easily flows into the crank chamber 15, so that the crank chamber pressure Pc increases. In this case, the inclination angle of the swash plate 23 decreases, so that the discharge displacement per one rotation of the drive shaft 19 is reduced. On the other hand, when the displacement control valve 13 reduces the communicating area between the first supply passage 41 and the second supply passage 43, the refrigerant at the discharge pressure Pd less easily flow into the crank chamber 15. Therefore, the refrigerant in the crank chamber 15 is easily drained to the suction chamber 5*a* through the bleed passage 52, so that the crank chamber pressure Pc is lowered. In this case, the inclination angle of the swash plate 23 increases, so that the discharge displacement is increased.

When the compressor is stopped at a minimum displacement state, and is shut down for a long term, the refrigerant in the crank chamber 15 is cooled and become liquid refrigerant. When the compressor is started again, the suction pressure Ps of the refrigerant being taken into the suction chamber 5*a* is lower than the set suction pressure, and the crank chamber pressure Pc is higher than the control pressure Pcv in the second supply passage 43.

In this case, in the opening degree regulating valve 61, as shown in FIG. 2, the first valve body 65 is located at the upper position, and the suction apertures 73*a* are closed by the first valve body 65. Therefore, an opening degree of the suction passage 51 decreases, and pressure variation in the suction pressure Ps at a low displacement is minimized, so that quiet can be ensured.

Further, the second valve body 67 is located at the lower position, and the bleed apertures 73*b* are opened by the second valve body 67. Accordingly, the bleed passage 52 is open. Therefore, at the time of startup, the liquid refrigerant being stored in the crank chamber 15 rapidly moves to the suction chamber 5*a* through the bleed communication hole 57, the bleed apertures 73*b*, the second valve chamber 71*b*, the first valve chamber 71*a*, the valve communication holes 75*a*, the first valve accommodation chamber 47*b* and the suction communication hole 50. Accordingly, the crank chamber pressure Pc is rapidly lowered, so that the displacement can be rapidly and easily increased.

Figure 3:
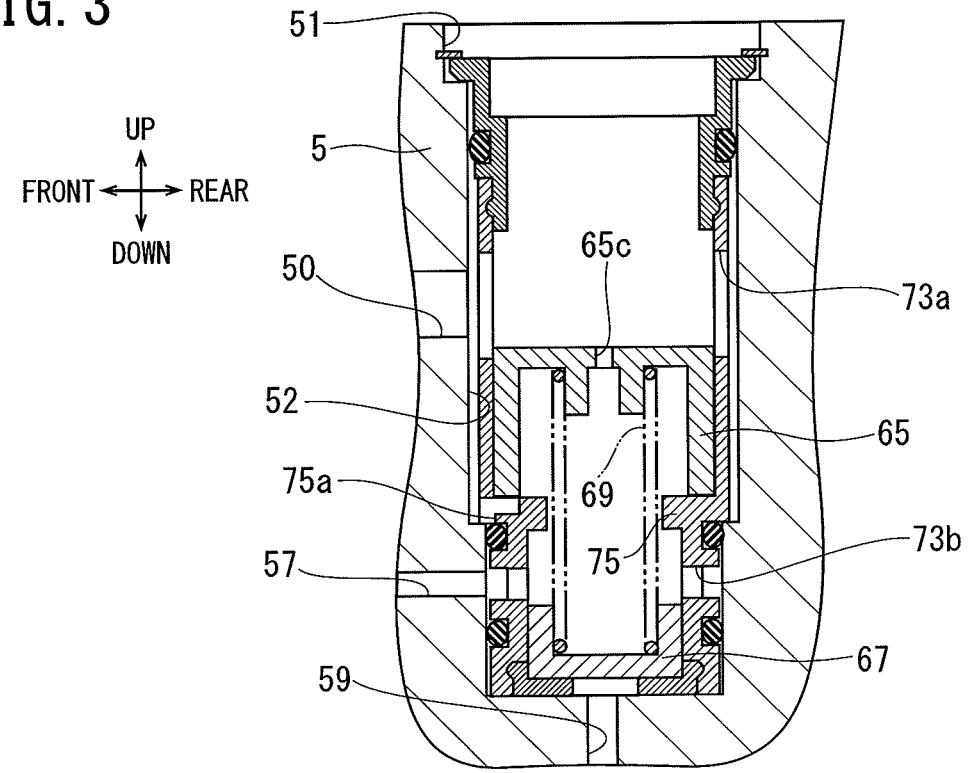
FIG. 3 is an enlarged sectional view of an essential part of the compressor according to embodiment 1 at a maximum displacement.

On the other hand, at a maximum displacement where the suction pressure Ps is higher than the set suction pressure, and the crank chamber pressure Pc is higher than the control pressure Pcv in the second supply passage 43, the opening degree regulating valve 61 is in a state shown in FIG. 3. In this case, the first valve body 65 is located at the lower position, and the suction apertures 73*a* are opened by the first valve body 65. Accordingly, the opening degree of the suction passage 51 is increased, so that it is possible to prevent pressure loss of the suction pressure Ps at a high displacement.

Further, the second valve body 67 is located at the lower position, and the bleed apertures 73*b* are opened by the second valve body 67. When the compressor is operated in the maximum displacement state, the inclination angle of the swash plate 23 is at maximum and hence, the high-pressure refrigerant in the discharge chamber 5*b* opens the check valve 55, so that the refrigerant is discharged to the condenser.

Figure 4:
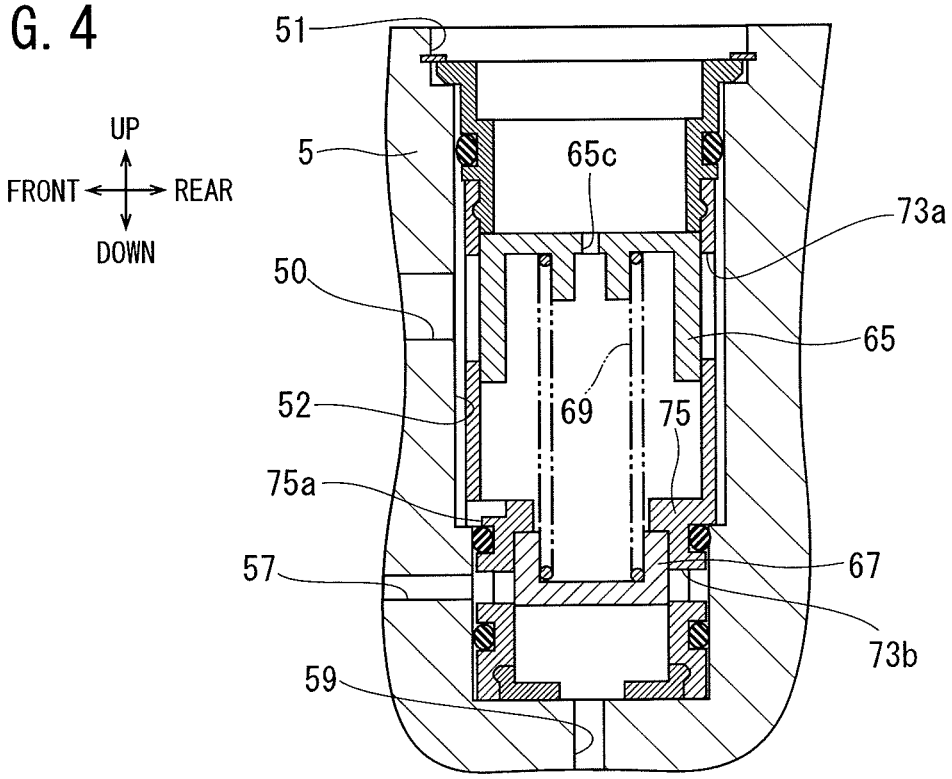
FIG. 4 is an enlarged sectional view of an essential part of the compressor according to embodiment 1 at a minimum displacement.

At the minimum displacement where the crank chamber pressure Pc is lower than the control pressure Pcv in the second supply passage 43, the opening degree regulating valve 61 is brought into a state shown in FIG. 4. In this case, the second valve body 67 is located at the upper position, and the first valve body 65 is located at the upper position by the biasing force of the bias spring 69. Accordingly, the suction apertures 73*a* are closed by the first valve body 65, and the opening degree of the suction passage 51 is reduced.

Further, the second valve body 67 is located at the upper position and the bleed apertures 73*b* are closed by the second valve body 67. Accordingly, the bleed passage 52 is closed. Therefore, the high-pressure refrigerant in the crank chamber 15 is not compressed again at the low displacement and hence, volumetric efficiency is increased.

Further, at this time, the crank chamber pressure Pc can be rapidly increased by the displacement control valve 13 and hence, the discharge displacement can be rapidly changed from high to low.

Further, in this compressor, it is not necessary to provide a bleed valve, capable of appropriately closing the bleed passage 52, separately from the opening degree regulating valve 61. Accordingly, the parts count is small and hence, reduction of manufacturing cost and improvement of design flexibility can be realized.

In a state where the compressor is operated at the minimum displacement state, the inclination angle of the swash plate 23 is just slightly larger than 0° and hence, the high-pressure refrigerant in the discharge chamber 5*b* cannot open the check valve 55, so that the refrigerant is not discharged to the condenser.

Accordingly, in this compressor, while pressure loss of the suction pressure Ps at the high displacement can be prevented, quiet at the low displacement can be also ensured. Further, this compressor has a high volumetric efficiency at the low displacement without causing an increase in manufacturing cost and reduction of design flexibility. Moreover, in this compressor, the liquid refrigerant or the like which may be filled in the crank chamber can be rapidly drained at the time of startup, so that displacement can be rapidly increased.

Moreover, in this compressor, the valve accommodation chamber 47 is formed in the rear housing 5, and the opening degree regulating valve 61 is inserted into the valve accommodation chamber 47 to form the first and second valve chambers 71*a* and 71*b*. Further, the communication port 50*a* of the suction communication hole 50, the bleed port 57*a* of the bleed communication hole 57, and the control port 59*a* of the control communication hole 59 open to the valve accommodation chamber 47, and the suction apertures 73*a*, the bleed apertures 73*b*, and the through hole 73*c* are formed in the opening degree regulating valve 61 and hence, the opening degree regulating valve 61 can be provided easily.

Particularly, in this compressor, the valve accommodation chamber 47 extends in the radial direction, and the communication port 50*a* and the bleed port 57*a* open to the valve accommodation chamber 47 in the axial direction. Further, the control port 59*a* opens to the valve accommodation chamber 47 in the radial direction at an end portion of the valve accommodation chamber 47 on a side being opposite to the inlet port 51*a*. Further, the opening degree regulating valve 61 includes the first valve body 65, the second valve body 67, and the bias spring 69. Accordingly, the opening degree regulating valve 61 can be provided more easily.

Further, the opening degree regulating valve 61 has the first valve chamber 71*a* and the second valve chamber 71*b*, and the flange 75 is formed between the first valve chamber 71*a* and the second valve chamber 71*b* and hence, the flange 75 can serve as a valve seat for the first valve body 65 and the second valve body 67. Accordingly, a circlip or the like for forming these valve seats becomes unnecessary and hence, further reduction of manufacturing cost can be realized.

Moreover, in the opening degree regulating valve 61, the second valve chamber 71*b* has a smaller diameter than the first valve chamber 71*a*, and the valve case 63 is accommodated in the valve accommodation chamber 47 and hence, the first valve chamber 71*a* and the second valve chamber 71*b* can be easily formed.

Further, in the opening degree regulating valve 61, the valve case 63 has the flange 75 between the first valve chamber 71*a* and the second valve chamber 71*b*, and the flange 75 makes the first valve chamber 71*a* and the second valve chamber 71*b* communicate with each other with an inner diameter thereof smaller than an outer diameter of the second valve body 67. When the second valve body 67 is located at the upper position, and the first valve body 65 is located at the upper position, a force of the first pressure receiving area S1×the suction pressure Ps acts on the inner surface of the second valve body 67, and a force of the second pressure receiving area S2×the control pressure Pcv acts on the lower surface of the second valve body 67. In the second valve body 67, the first pressure receiving area S1 is smaller than the second pressure receiving area S2 (first pressure receiving area S1<second pressure receiving area S2) and hence, the second valve body 67 reacts more sensitively to a drop of the control pressure Pcv. Accordingly, the bleed passage 52 can be easily released again.

Embodiment 2

Figure 5:
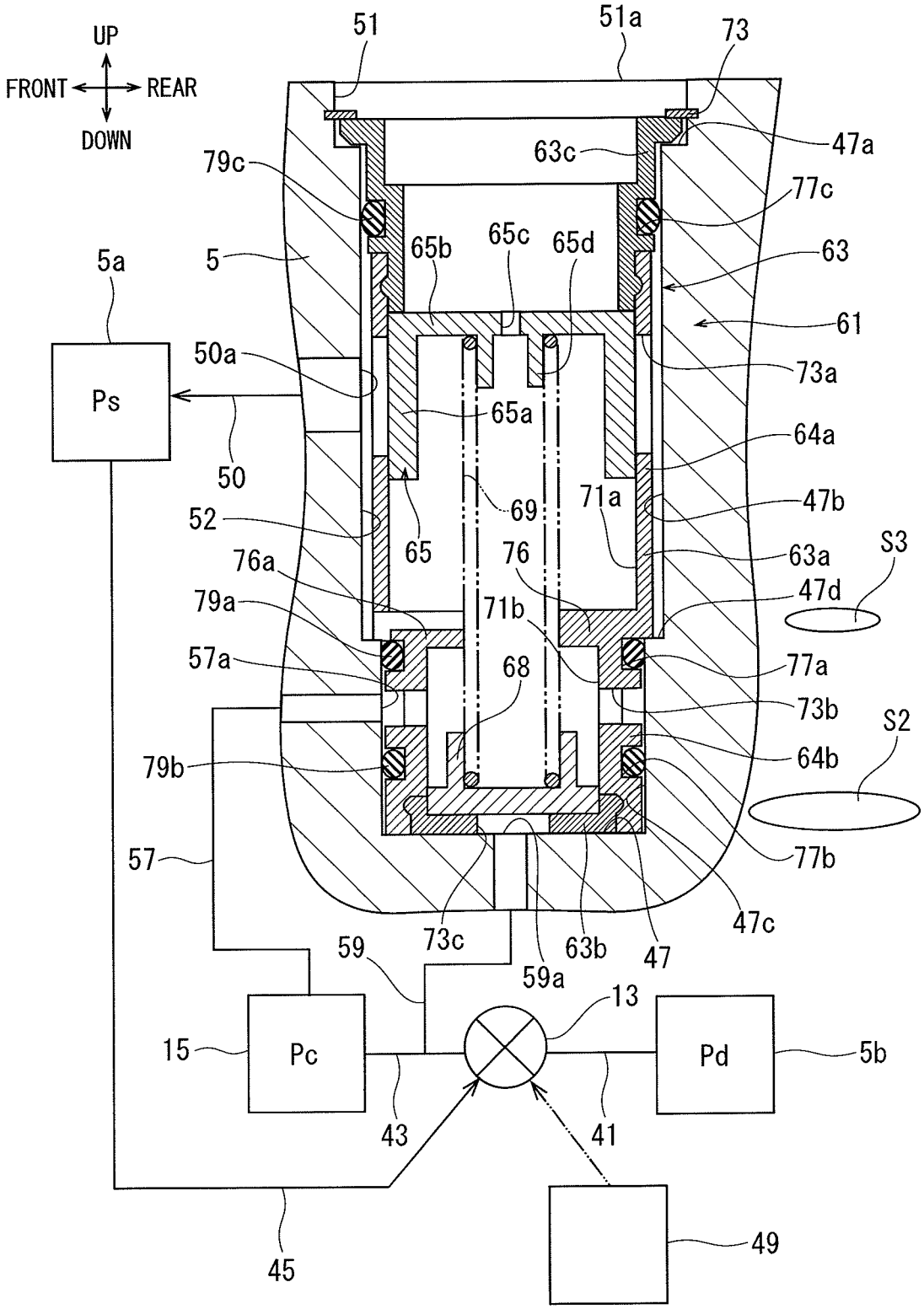
FIG. 5 is an enlarged sectional view of an essential part of a compressor according to embodiment 2 at the time of startup.
Figure 6:
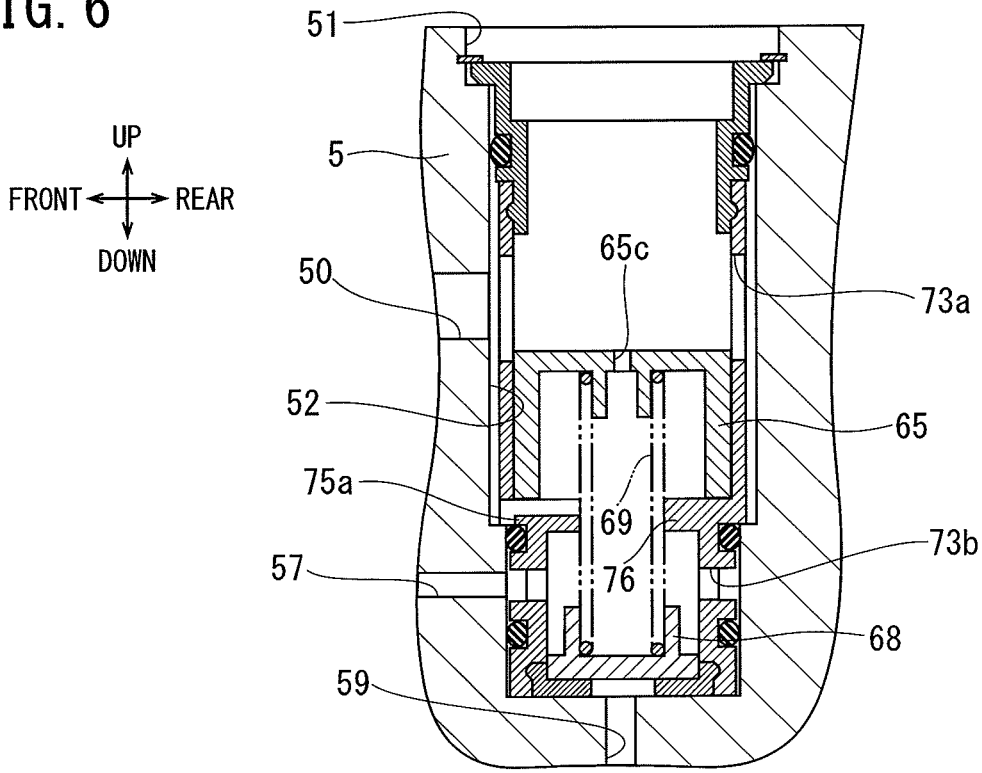
FIG. 6 is an enlarged sectional view of an essential part of the compressor according to embodiment 2 at a maximum displacement.
Figure 7:
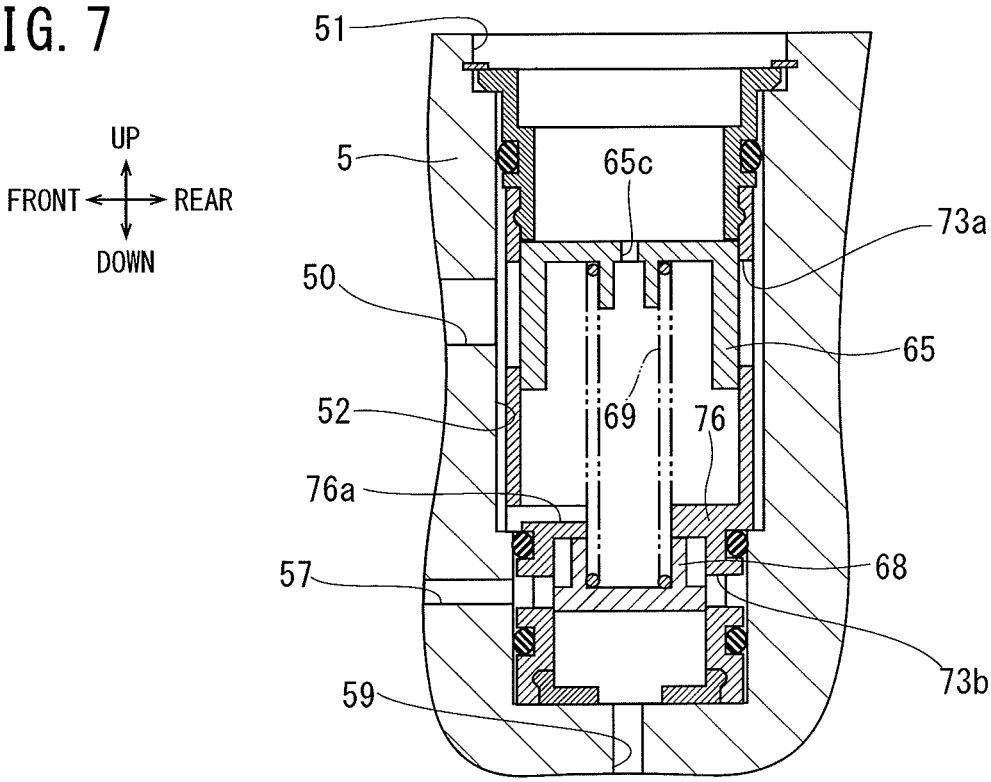
FIG. 7 is an enlarged sectional view of an essential part of the compressor according to embodiment 2 at a minimum displacement.

As shown in FIGS. 5 to 7, in a compressor of embodiment 2, a flange 76 inwardly projects more largely than the flange 75 according to embodiment 1. A valve communication hole 76*a* which is longer than the valve communication hole 75*a* according to embodiment 1 in the radial direction is formed in the flange 76 in the circumferential direction.

Further, the upper surface of a second valve body 68 is set smaller than the upper surface of the second valve body 67 according to embodiment 1. Accordingly, when the second valve body 68 is seated on the flange 76, a first pressure receiving area S3 is provided on the upper surface corresponding to an inner diameter of the flange 76. The first pressure receiving area S3 is set smaller than the first pressure receiving area S1 according to embodiment 1. The other components of this embodiment are the same as those of embodiment 1.

In this compressor, the first pressure receiving area S3 is set smaller than the first pressure receiving area S1 and hence, the compressor reacts more sensitively to a drop of the control pressure Pcv whereby the bleed passage 52 is easily released again. The other advantageous effects of this embodiment are the same as those of embodiment 1. As described above, in this compressor, tuning can be easily performed by regulating the first pressure receiving area S3 of the opening degree regulating valve 61.

Embodiment 3

Figure 8:
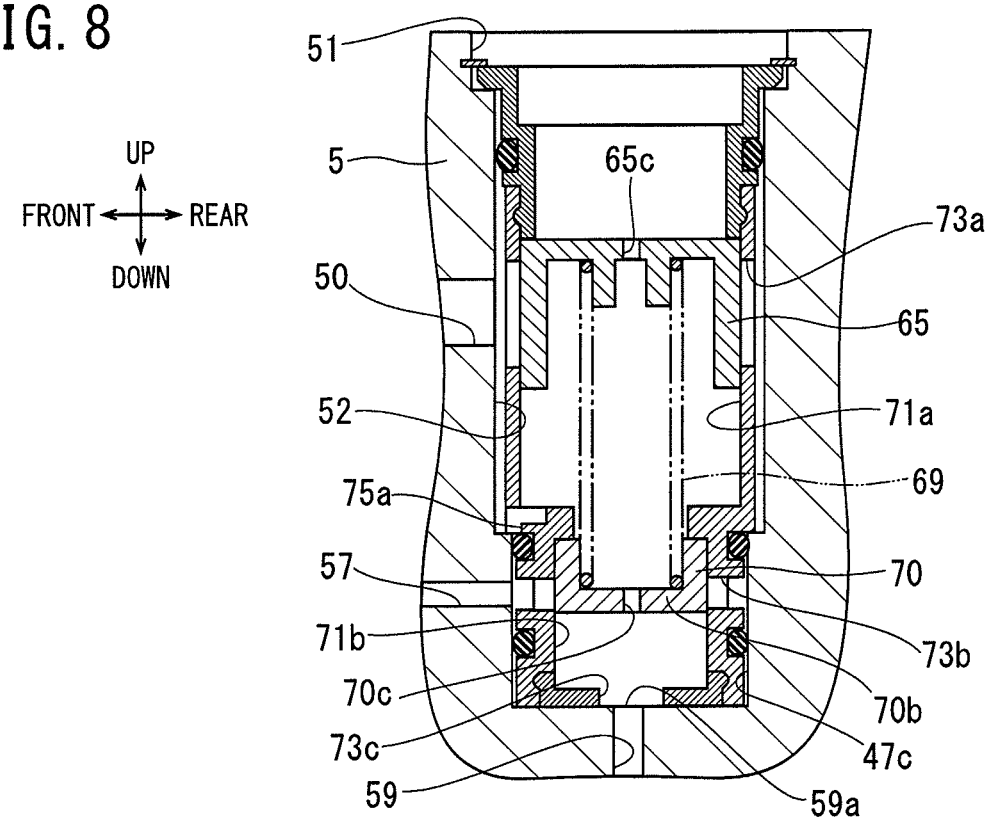
FIG. 8 is an enlarged sectional view of an essential part of a compressor according to embodiment 3 at a minimum displacement.
Figure 9:
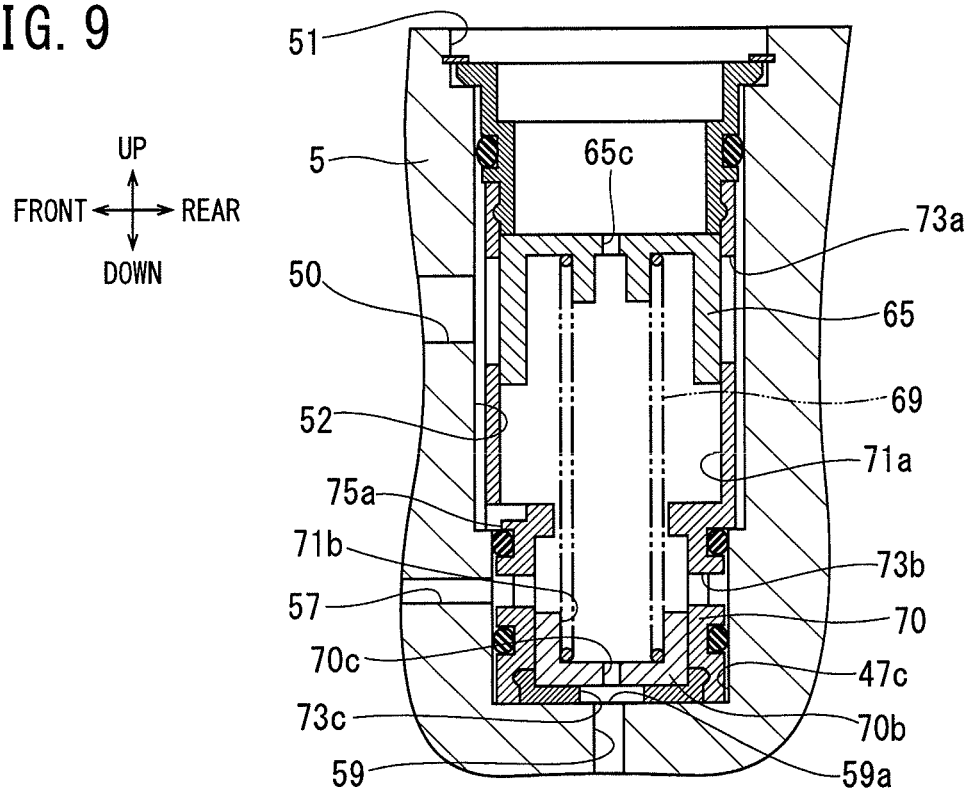
FIG. 9 is an enlarged sectional view of an essential part of the compressor according to embodiment 3 at the time of startup.

As shown in FIG. 8 and FIG. 9, in a compressor of embodiment 3, a fine hole 70*c* is formed in a lid portion 70*b* of a second valve body 70. The fine hole 70*c* makes the control communication hole 59 and the second valve chamber 71*b* communicate with each other through the control port 59*a*, the second valve accommodation chamber 47*c* and the through hole 73*c*. The other components of this embodiment are the same as those of embodiment 1.

In this compressor, as shown in FIG. 8, at the minimum displacement where the crank chamber pressure Pc is lower than the control pressure Pcv in the second supply passage 43, the second valve body 70 is located at the upper position, and the first valve body 65 is also located at the upper position by the biasing force of the bias spring 69. In this case, the bleed apertures 73*b* are closed by the second valve body 70, and the bleed passage 52 is closed. Further, the suction apertures 73*a* are closed by the first valve body 65, and an opening degree of the suction passage 51 is reduced.

Further, in this compressor, as shown in FIG. 9, when the control pressure Pcv drops, the second valve body 70 moves to the lower position. At this time, the pressure in the first valve chamber 71*a* and the second valve chamber 71*b* can be released through the fine hole 70*c* and hence, the second valve body 70 can easily move, so that controllability is enhanced. The other advantageous effects of this embodiment are the same as those of embodiment 1.

Embodiment 4

Figure 10:
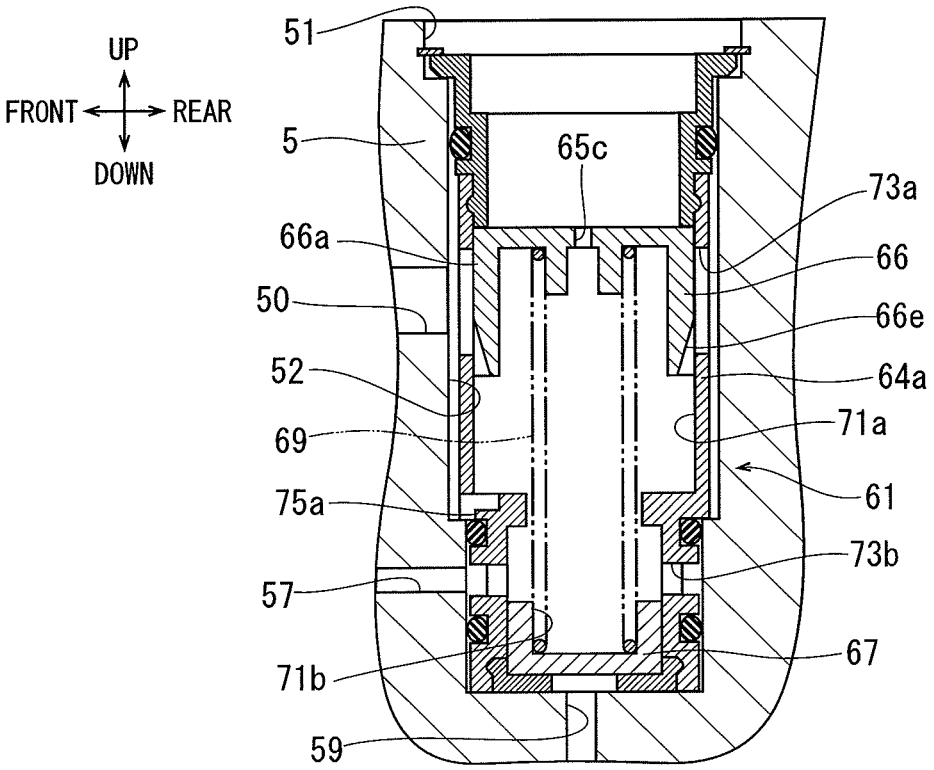
FIG. 10 is an enlarged sectional view of an essential part of a compressor according to embodiment 4 at the time of startup.

In a compressor of embodiment 4, as shown in FIG. 10, a number of startup release paths 66*e* are formed at a lower portion of a cylindrical portion 66*a* of a first valve body 66 in the circumferential direction. The startup release path 66*e* is formed into a tapered shape such that the thickness of the cylindrical portion 66*a* decreases inwardly from the substantially intermediate portion of the cylindrical portion 66*a* as the cylindrical portion 66*a* extends downward. The other components of this embodiment are the same as those of embodiment 1.

When the compressor is stopped at the minimum displacement state, and is shut down for a long term, there may be a case where the refrigerant in the crank chamber 15 is cooled and become a liquid refrigerant. When the compressor is started again, the suction pressure Ps of the refrigerant being taken into the suction chamber 5*a* is lower than the set suction pressure, and the crank chamber pressure Pc is higher than the control pressure Pcv in the second supply passage 43. Accordingly, in the opening degree regulating valve 61, at the time of startup, the first valve body 66 is located at the upper position, and the second valve body 67 is located at the lower position.

In such a state, in this compressor, the first valve chamber 71*a* and the suction apertures 73*a* are made to communicate with each other through the startup release paths 66*e*. Therefore, at the time of startup, the liquid refrigerant being stored in the crank chamber 15 can move to the suction chamber 5*a* more rapidly. To be more specific, the liquid refrigerant moves to the suction chamber 5*a* through the bleed communication hole 57, the bleed apertures 73*b*, the second valve chamber 71*b*, the first valve chamber 71*a*, the startup release paths 66*e*, the suction apertures 73*a*, the first valve accommodation chamber 47*b* and the suction communication hole 50. Accordingly, the crank chamber pressure Pc is lowered more rapidly and hence, the displacement can be increased more rapidly and easily. The other advantageous effects of this embodiment are the same as those of embodiment 1.

Although the present invention has been described above in line with embodiments 1 to 4, it is needless to say that the invention is not limited to the above-described embodiments 1 to 4, but may be appropriately modified in application without departing from the gist of the invention.

For example, whereas only the second valve body 67 opens and closes the bleed passage 52 in the compressors of the above-mentioned embodiments 1 to 4, the first valve body 65 and the second valve body 67 may be configured to open and close the bleed passage 52.

Further, when the suction pressure of the refrigerant being taken into the suction chamber is lower than the set suction pressure, and the crank chamber pressure is higher than the control pressure in the second supply passage, and when the suction pressure is higher than the set suction pressure, and the crank chamber pressure is higher than the control pressure, the bleed passage may be opened through a gap formed between the valve accommodation chamber and the first valve body, a gap formed between the valve case and the first valve body, or the like.

Also, whereas a valve which regulates the communicating area between the first supply passage 41 and the second supply passage 43 is adopted as the displacement control valve 13 in the compressors of the above-mentioned embodiments 1 to 4, a displacement control valve which regulates a communicating area between the supply passage and the bleed passage simultaneously may be adopted as the displacement control valve 13.

Moreover, whereas the startup release paths 66*e* are formed in the cylindrical portion 66*a* of the first valve body 66 in the compressor according to the above-mentioned embodiment 4, the startup release paths may be formed in the large-diameter portion 64*a* of the cylindrical body 63*a*. Alternatively, the startup release paths may be formed in both of the cylindrical portion 66*a* of the first valve body 66 and the large-diameter portion 64*a* of the cylindrical body 63*a*.

The invention claimed is:

1. A variable displacement swash plate type compressor comprising:

a housing having a suction chamber, a cylinder bore, a crank chamber, and a discharge chamber;

a swash plate provided in the crank chamber, an inclination angle of the swash plate being changed depending on a crank chamber pressure in the crank chamber;

a piston accommodated in the cylinder bore and forming a compression chamber between the piston and the housing, the piston that sucks refrigerant in the suction chamber into the compression chamber, compresses the refrigerant in the compression chamber, and discharges the high-pressure refrigerant to the discharge chamber from the compression chamber by reciprocating in the cylinder bore with a stroke corresponding to the inclination angle; and a displacement control valve provided in the housing, and being capable of changing the crank chamber pressure, wherein a suction passage that connects the outside to the suction chamber, a first supply passage that makes the discharge chamber and the displacement control valve communicate with each other, a second supply passage that connects the displacement control valve to the crank chamber, and a bleed passage that connects the crank chamber to the suction chamber are formed in the housing, a valve chamber that has an inlet port opening to the outside and extends in a first direction, a suction communication hole that communicates with the suction chamber and has a communication port opening to the valve chamber, a bleed communication hole that communicates with the crank chamber and has a bleed port opening to the valve chamber, and a control communication hole that communicates with the second supply passage and has a control port opening to the valve chamber are formed in the housing, a first valve body that is movable in the first direction and changes an opening area of the communication port, a second valve body that is movable in the first direction and changes an opening area of the bleed port, and a bias spring that connects the first valve body to the second valve body are accommodated in the valve chamber, when a suction pressure of the refrigerant being taken into the suction chamber is lower than a set suction pressure, and the crank chamber pressure is higher than a control pressure in the second supply passage, the first valve body is configured to reduce an opening degree of the suction passage, and the second valve body is configured to open the bleed passage, when the suction pressure is higher than the set suction pressure, and the crank chamber pressure is higher than the control pressure, the first valve body is configured to increase the opening degree of the suction passage, and the second valve body is configured to open the bleed passage, and when the crank chamber pressure is lower than the control pressure, the first valve body is configured to reduce the opening degree of the suction passage, and the second valve body is configured to close the bleed passage.

2. The variable displacement swash plate type compressor according to claim 1, wherein the communication port is located at a position close to the outside, and opens to the valve chamber in a second direction that intersects with the first direction, the bleed port is located at a position farther away from the outside than the communication port, and opens to the valve chamber in the second direction, the control port opens to the valve chamber in the first direction at an end portion of the valve chamber on a side being opposite to the inlet port, the first valve body receives the suction pressure via the inlet port, and is capable of closing the communication port, the second valve body receives the control pressure via the control port, and is capable of closing the bleed port, and the bias spring is disposed between the first valve body and the second valve body, and has a biasing force that spaces the first valve body away from the second valve body.

3. The variable displacement swash plate type compressor according to claim 1, wherein a fine hole that makes the control communication hole and the valve chamber communicate with each other is formed in the second valve body.

4. The variable displacement swash plate type compressor according to claim 1, wherein the valve chamber comprises: a first valve chamber having a columnar shape and allowing the first valve body to move; and a second valve chamber communicating with the first valve chamber, having a columnar shape which is coaxial with the first valve chamber and has a diameter different from a diameter of the first valve chamber, and allowing the second valve body to move.

5. The variable displacement swash plate type compressor according to claim 4, wherein the second valve chamber is smaller in diameter than the first valve chamber, and the housing has: a housing body in which a valve accommodation chamber is formed; and a valve case accommodated in the valve accommodation chamber with an O-ring interposed between the valve case and the valve accommodation chamber, and forming the first valve chamber and the second valve chamber.

6. The variable displacement swash plate type compressor according to claim 5, wherein the bleed passage has: a bleed aperture formed in the valve case, and making the valve accommodation chamber and the second valve chamber communicate with each other; and a valve communication hole formed in the valve case, and making the valve accommodation chamber and the first valve chamber communicate with each other.

7. The variable displacement swash plate type compressor according to claim 6, wherein the suction passage has a suction aperture formed in the valve case, and making the valve accommodation chamber and the first valve chamber communicate with each other, and a startup release path is formed in at least one of the valve case and the first valve body, the startup release path making the first valve chamber and the suction aperture communicate with each other only when the suction pressure is lower than the set suction pressure, and the crank chamber pressure is higher than the control pressure.

8. The variable displacement swash plate type compressor according to claim 5, wherein the valve case has a flange between the first valve chamber and the second valve chamber, and the flange makes the first valve chamber and the second valve chamber communicate with each other with an inner diameter smaller than an outer diameter of the second valve body.

* * * * *